US007591682B2

(12) United States Patent
Umemura et al.

(10) Patent No.: US 7,591,682 B2
(45) Date of Patent: Sep. 22, 2009

(54) CONNECTOR

(75) Inventors: Yuji Umemura, Tokyo (JP); Yukitaka Tanaka, Tokyo (JP); Goro Haga, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/154,097

(22) Filed: May 20, 2008

(65) Prior Publication Data

US 2008/0299832 A1 Dec. 4, 2008

(30) Foreign Application Priority Data

May 29, 2007 (JP) ..... 2007-142288

(51) Int. Cl.
*H01R 25/00* (2006.01)

(52) U.S. Cl. ..... 439/638; 439/598

(58) Field of Classification Search ..... 439/638–640, 439/650–655, 598
See application file for complete search history.

(56) References Cited

U.S. PATENT DOCUMENTS 3,200,355 A * 8/1965 Dahlen ..... 333/183
3,721,943 A * 3/1973 Curr ..... 439/273
4,421,378 A * 12/1983 Sanford et al. ..... 439/686
4,666,222 A * 5/1987 Gallusser et al. ..... 439/733.1
5,890,930 A * 4/1999 Gerow ..... 439/651
7,172,467 B1 * 2/2007 Yohn et al. ..... 439/686
2008/0299832 A1 * 12/2008 Umemura et al. ..... 439/638

FOREIGN PATENT DOCUMENTS

JP 62-131485 A 6/1987

* cited by examiner

*Primary Examiner*—James Harvey
(74) *Attorney, Agent, or Firm*—Frishauf, Holtz, Goodman & Chick, P.C.

(57) ABSTRACT

A connector which makes it possible to take out a holding member thereof from a housing without breaking the housing. The housing is formed by a main housing and a sub housing connected to the main housing. The main housing is formed with a hole having a contact portion-accommodating portion and a contact-inserting portion. In the sub housing, there is formed a clip-accommodating hole which is opposed to the contact portion-accommodating portion and the contact-inserting portion in the directions of insertion and removal of the contact, when the sub housing is connected to the main housing. The inner diameter of the clip-accommodating hole is set to be larger than the inner diameter of the contact portion-accommodating portion and that of the contact-inserting portion. The clip is accommodated in the clip-accommodating hole.

7 Claims, 12 Drawing Sheets

CONNECTOR

BACKGROUND OF THE INVENTION

1. Field of the Invention

This invention relates to a connector, and more particularly to a connector which is suitably used under vacuum environment.

2. Description of the Related Art

Conventionally, there has been proposed a connector that is comprised of an insulating material (housing), holding clips, and socket contacts (see Japanese Laid-Open Patent Publication (Kokai) No. S62-131485 (page 3, lower left column, line 6 to upper right column, line 1; FIG. 1).

The insulating material is formed with a plurality of cavities. The cavities are spaces having a generally cylindrical shape, and each have a small-diameter portion, a large-diameter portion, and a medium-diameter portion. The small-diameter portion is located at an end of the housing toward a mating connector. The medium-diameter portion is located at an end of the housing opposite from the end toward the mating connector. The large-diameter portion is located between the small-diameter portion and the medium-diameter portion.

Each holding clip has a generally hollow cylindrical shape, and is made of an elastic material. The holding clip has an outer peripheral surface formed with a pair of spring pieces opposed to each other. The pair of spring pieces are cantilevered, and the distance therebetween becomes shorter toward foremost ends (free ends) thereof. Further, the outer peripheral surface of the holding clip is formed with a slit parallel to the central axis of the holding clip. When the holding clip is radially urged, the width of the slit is reduced to reduce the outer diameter of the holding clip.

Each socket contact has a shape in which three cylinders having different outer diameters are continuous in a line.

This connector is assembled as follows:

First, the outer diameter of the holding clip is reduced, and in this state, the holding clip is inserted into the large-diameter portion of one of the cavities of the housing via the medium-diameter portion thereof. The outer diameter of the holding clip inserted into the large-diameter portion returns to its original state to bring the holding clip into intimate contact with the inner surface of the large-diameter portion.

Then, the socket contact is inserted into the small-diameter portion and the large-diameter portion via the medium-diameter portion. The socket contact inserted into the small-diameter portion and the large-diameter portion is engaged with the spring pieces of the holding clip, which inhibits the socket contact from being drawn out from the cavity.

On the other hand, when it is necessary to disassemble the connector e.g. for repair, a hollow cylindrical jig is inserted between the spring pieces of the holding clip and the socket contact to disengage the spring pieces and the socket contact from each other. This makes it possible to draw out the contact from the housing.

In the above-described connector, when the connector is disassembled e.g. for repair, it is possible to draw out the socket contact from the housing, but it is impossible to draw out the holding clips therefrom. Therefore, when one of the holding clips and the housing is damaged or broken, which requires replacement thereof, it becomes necessary to replace both the holding clip and the housing.

If the holding clip has to be drawn out from the housing, it is necessary to break a portion of the housing defining a third hole therein.

In a connector used in the atmosphere, an inexpensive resin can be used as a material of the housing, and the holding clips are manufactured at low costs. Therefore, even if both the holding clip and the housing are replaced, it cannot cause a serious problem.

Recently, the use of connectors has been widened, and there exists a connector that is used in a vacuum. Although the connector used in a vacuum has the same construction as that of the above-described connector, ceramic is used as a material of a housing thereof so as to prevent occurrence of outgassing from the housing.

Also in the connector used in a vacuum, when it becomes necessary to replace damaged holding clips, the holding clips are replaced together with the housing of the connector.

However, since the ceramic housing of the connector used in a vacuum is very expensive, it is uneconomical to replace the damaged holding clips together with the housing that is not damaged.

SUMMARY OF THE INVENTION

The present invention has been made in view of these circumstances, and an object thereof is to provide a connector which makes it possible to take out a holding member for a contact without breaking a housing.

To attain the above object, the present invention provides a connector comprising a contact, a housing that has a insertion hole for inserting the contact, the housing including a first housing component part, and a second housing component part connected to the first housing component part, the insertion hole having a first hole formed in the first housing component part, and a second hole formed in the second housing component part such that the second hole is opposed to the first hole in directions of insertion and removal of the contact, and a holding member that has a generally hollow cylindrical shape, and holds the contact inserted into the insertion hole, the holding member being accommodated in the first hole or the second hole such that the holding member is restricted in motion in the directions of insertion and removal of the contact when the first housing component part and the second housing component part are connected to each other.

With the arrangement of this connector, when the first housing component part and the second housing component parts are disconnected from each other, the restriction on the motion of the holding member in the directions of insertion and removal of the contacts is released.

According to the present invention, it is possible to take out the holding member for the contact from the housing without breaking the housing.

Preferably, the connector further comprises a shell mounted on the housing in a manner covering the housing, the shell comprising a first shell component part and a second shell component part which can be separated in the directions of insertion and removal of the contacts.

Preferably, the first shell component part and the second component part are connected by threads.

Preferably, the first hole has a diameter smaller than a diameter of the second hole, and the diameter of the first hole is smaller than an outer diameter of the holding member.

Preferably, the first hole has a diameter smaller than a diameter of the second hole, and the diameter of the second hole is smaller than an outer diameter of the holding member.

Preferably, the the holding member includes an engagement spring that protrudes radially inward of the holding member, for engagement with an engagement portion of the contact.

Preferably, the housing is made of a ceramic material.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
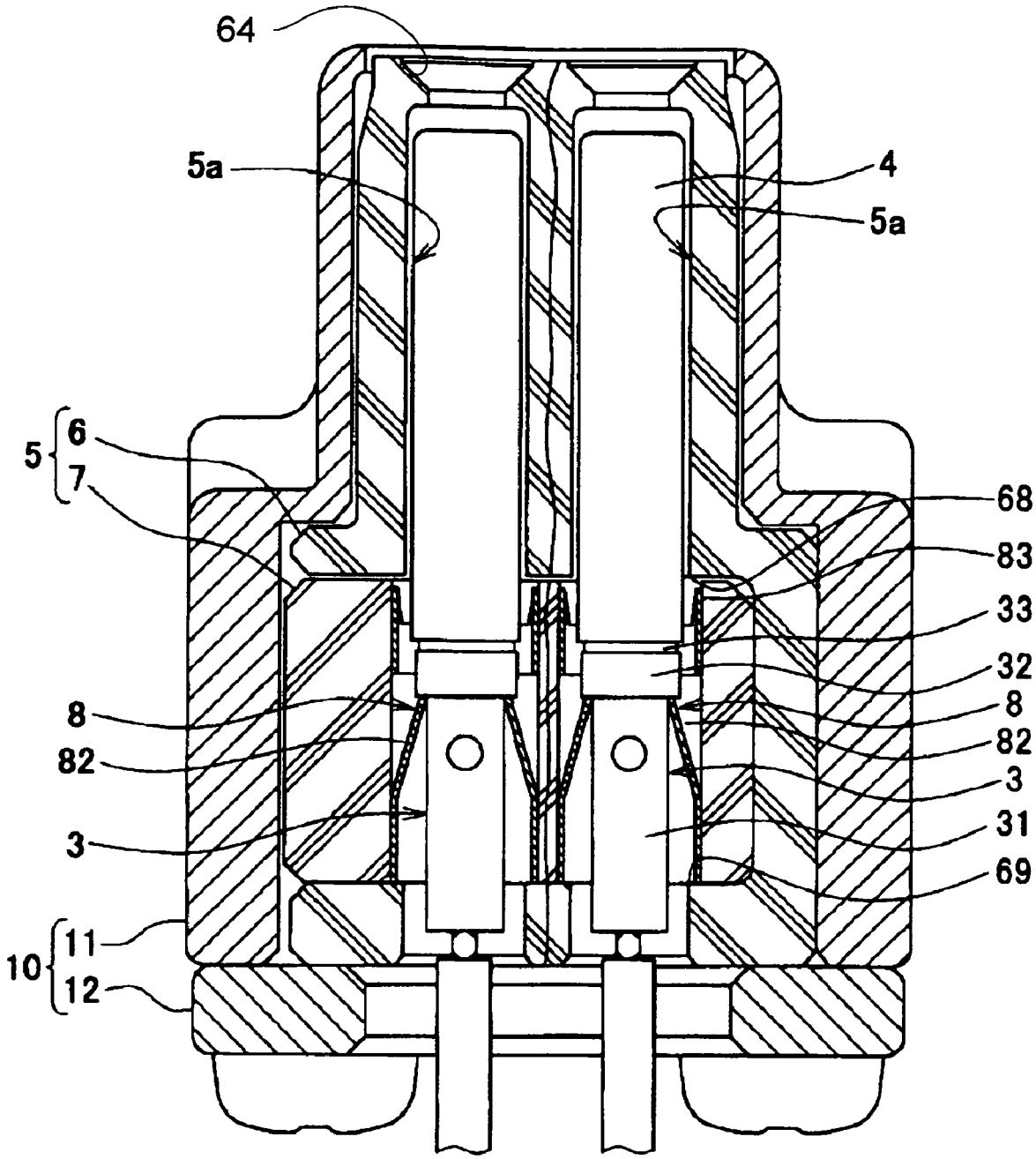
FIG. 1 is a cross-sectional view of a connector according to a first embodiment of the present invention.
Figure 2A:
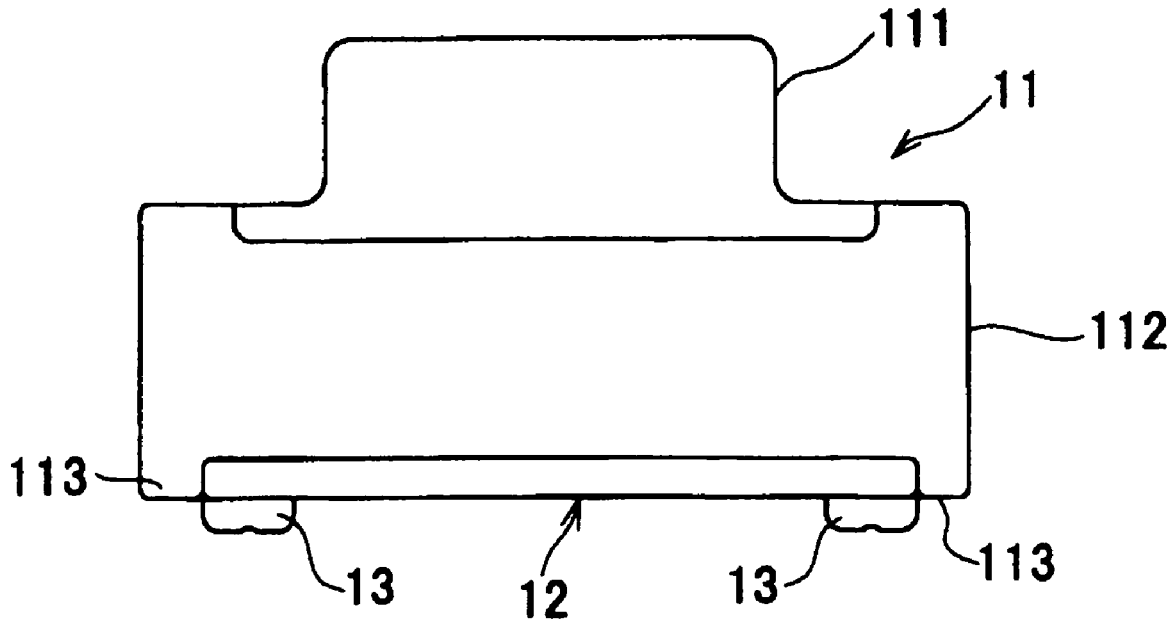
FIG. 2A is a front view of the FIG. 1 connector.
Figure 2B:
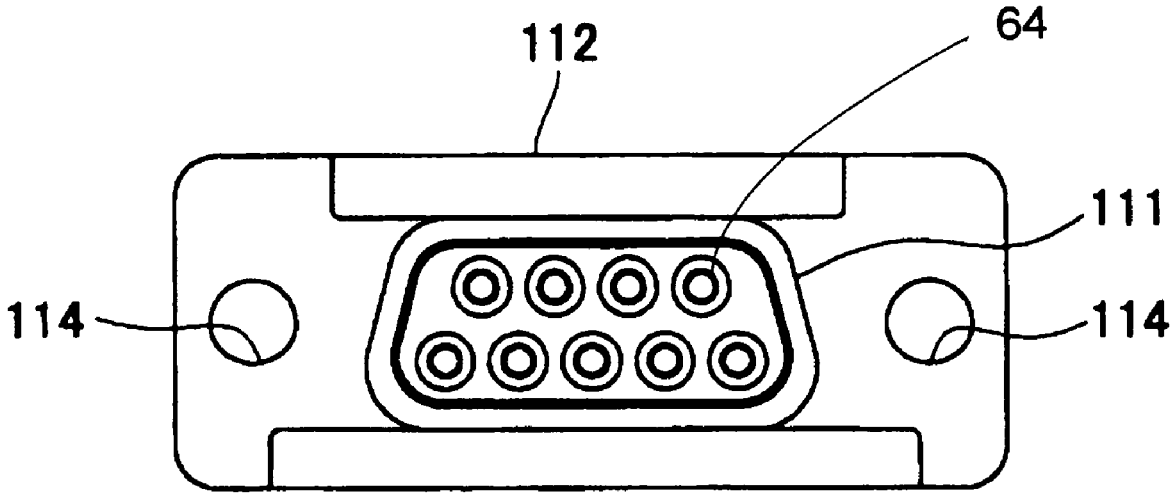
FIG. 2B is a top view of the FIG. 1 connector.
Figure 2C:
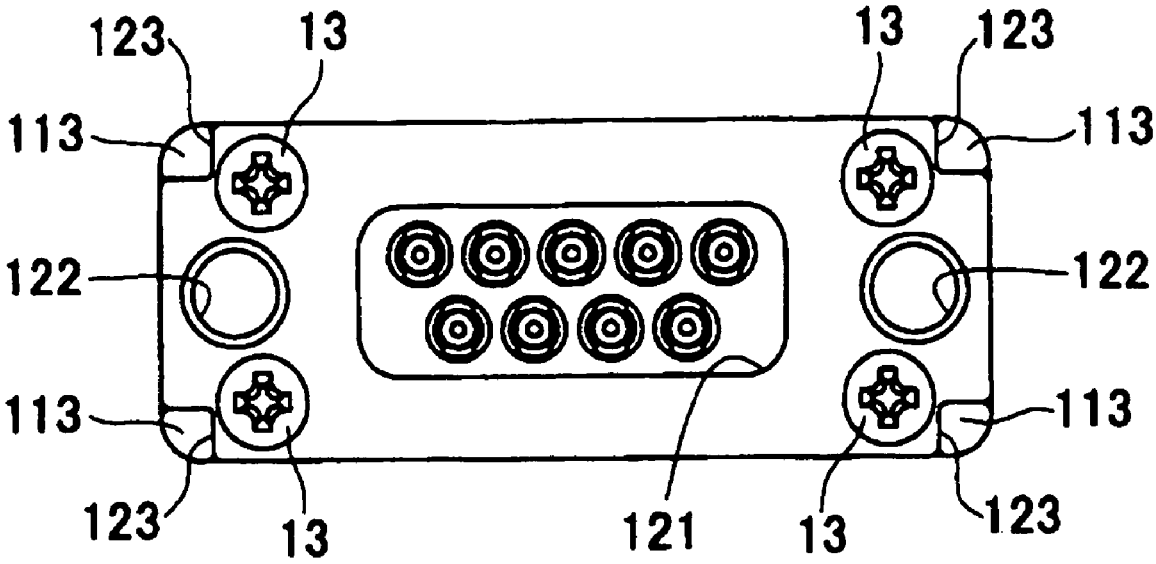
FIG. 2C is a bottom view of the FIG. 1 connector.
Figure 2D:
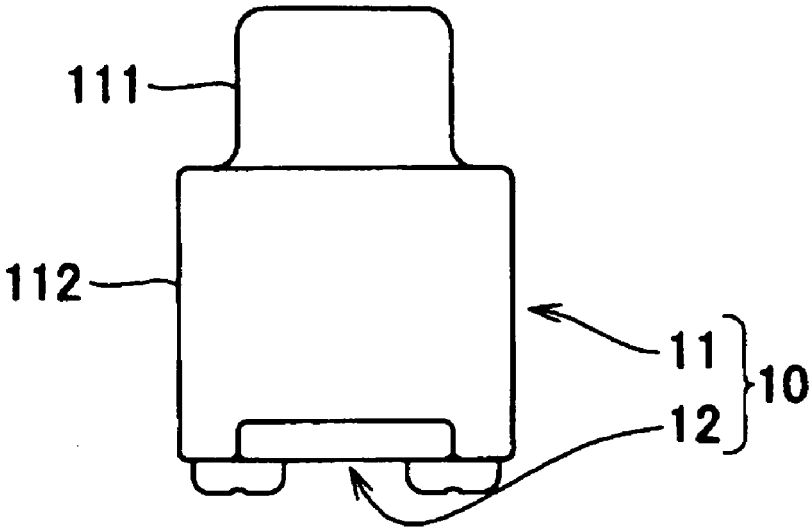
FIG. 2D is a side view of the FIG. 1 connector.

FIGS. 1 to 2D show a connector according to a first embodiment of the present invention.

Referring to FIG. 1 and FIGS. 2A to 2D, the connector is comprised of socket contacts (contacts) 3, a housing 5, clips (holding members) 8, and a shell 10.

Figure 7:
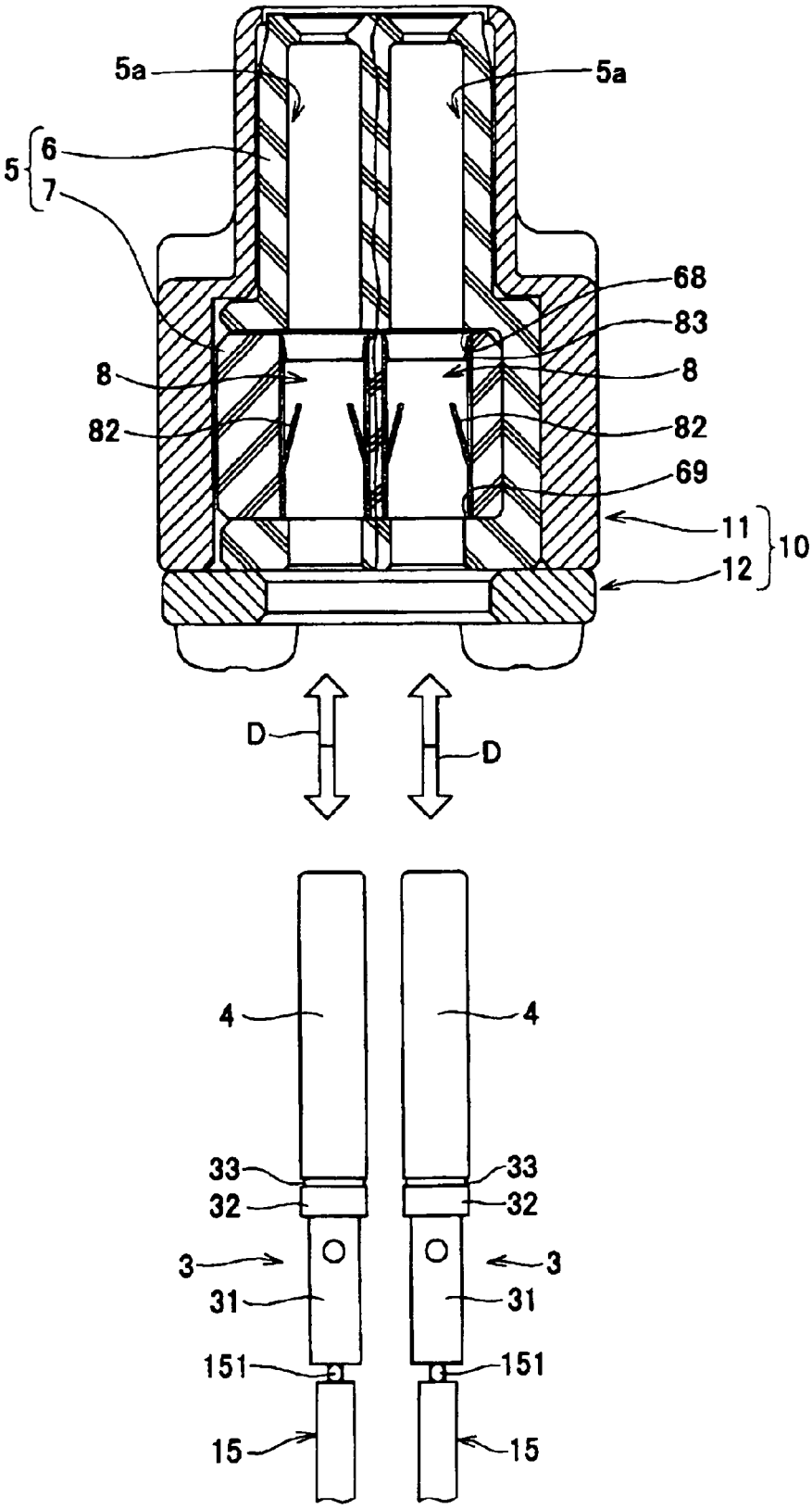
FIG. 7 is a cross-sectional view of the housing of the FIG. 1 connector and a contact showing a state in which the contact is inserted into and removed from the housing.
Figure 9:
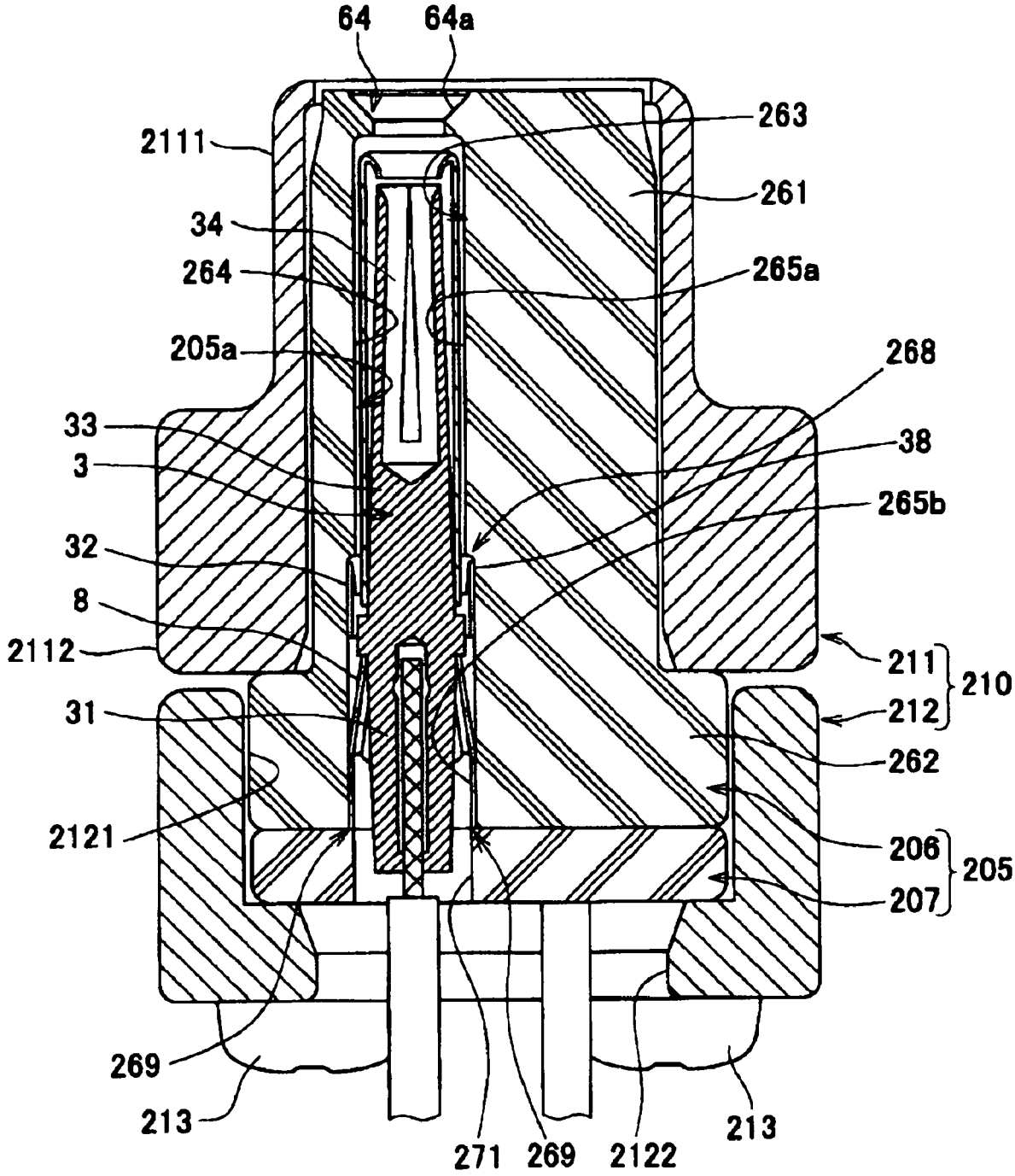
FIG. 9 is a cross-sectional view of a connector according to a second embodiment of the present invention.
Figure 10A:
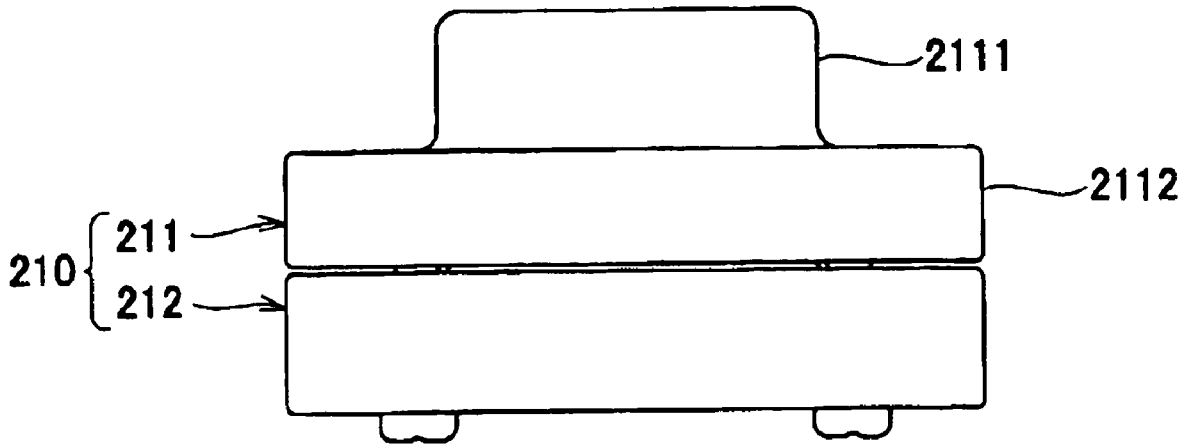
FIG. 10A is a front view of the FIG. 9 connector.
Figure 10B:
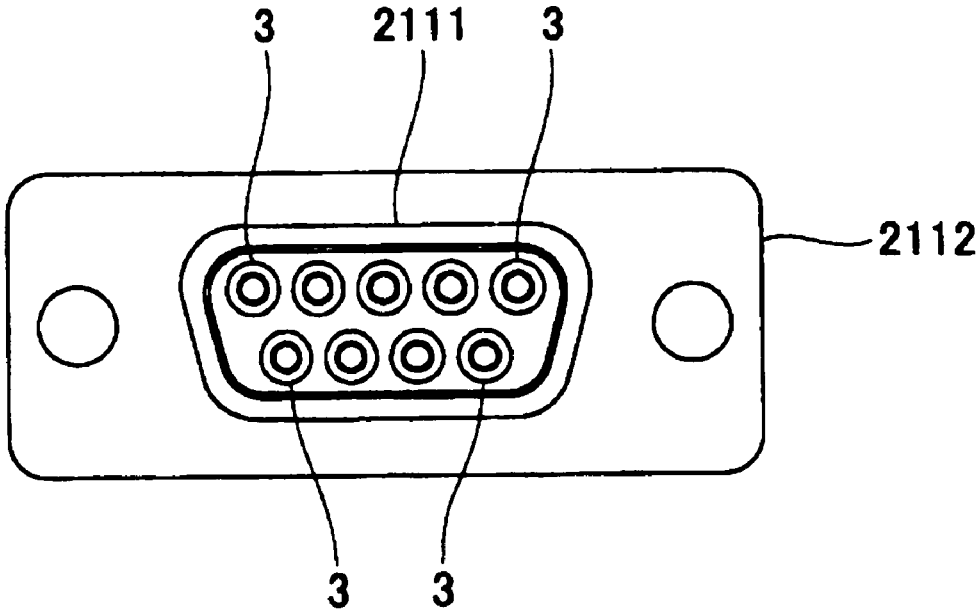
FIG. 10B is a plan view of the FIG. 9 connector.
Figure 10C:
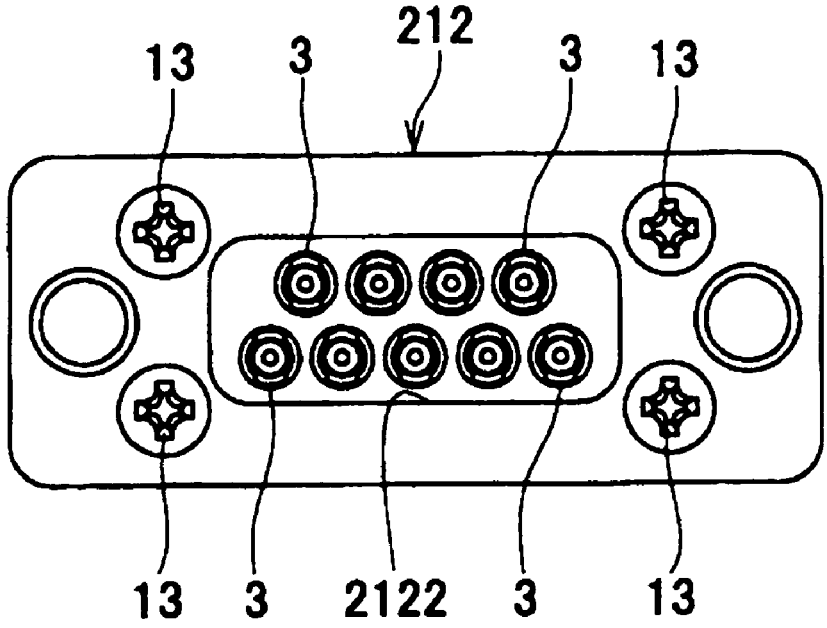
FIG. 10C is a bottom view of the FIG. 9 connector.
Figure 10D:
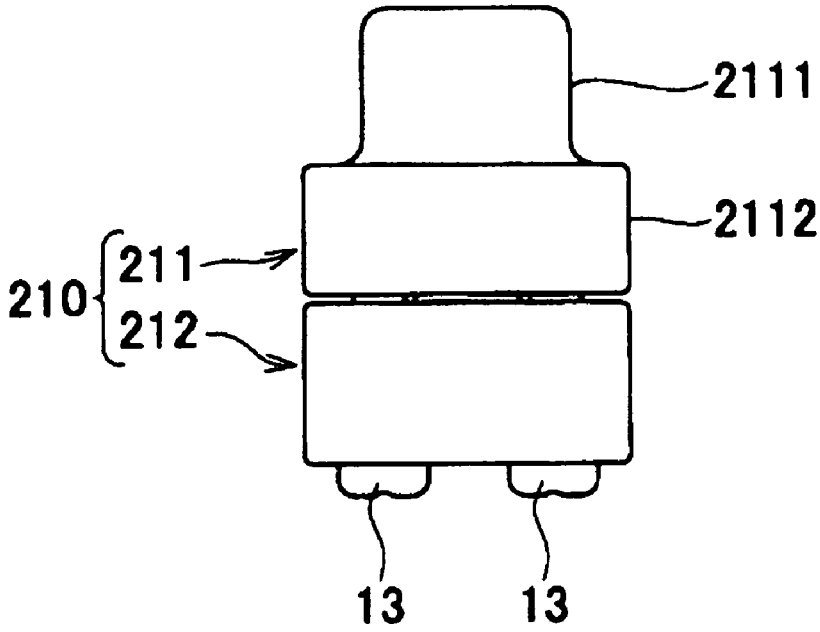
FIG. 10D is a side view of the FIG. 9 connector.

Each socket contact 3 includes a connection portion 31, a flange portion 32, a sleeve-mounting portion 33 (see FIG. 7), and a contact portion 34 (see FIG. 9, since the construction of the contact portion 34 and its associated portions is the same as that of the corresponding portions of a second embodiment described hereinafter with reference to FIGS. 9 to 10D). The connection portion 31 has a generally hollow cylindrical shape. To the connection portion 31 is connected a core 151 of a cable 15. The flange portion 32 has an outer diameter larger than that of the connection portion 31. The sleeve-mounting portion 33 is continuous with the flange portion 32. The sleeve-mounting portion 33 has an outer diameter smaller than that of the flange portion 32. A sleeve 4 is mounted on the sleeve-mounting portion 33. The sleeve 4 protects the contact portion 34. The contact portion 34 is connected to the sleeve-mounting portion 33. The contact portion 34 and a mating connector, not shown, are brought into contact with each other with a pin contact of the mating connector sandwiched therebetween.

Next, a description will be given of a main housing and a sub housing of the connector shown in FIG. 1, with reference to FIGS. 3 and 4. It should be noted that FIGS. 1 and 3 are cross-sectional views taken on different lines, and hence the connectors in FIGS. 1 and 3 have different shapes in cross-section (FIG. 1 is a cross-sectional view of the connector stepwise cut such that there appear two insertion holes 5*a*).

As shown in FIG. 1, the housing 5 is comprised of the main housing 6 (first component part of the housing) and the sub housing 7 (second component part of the housing).

Figure 3:
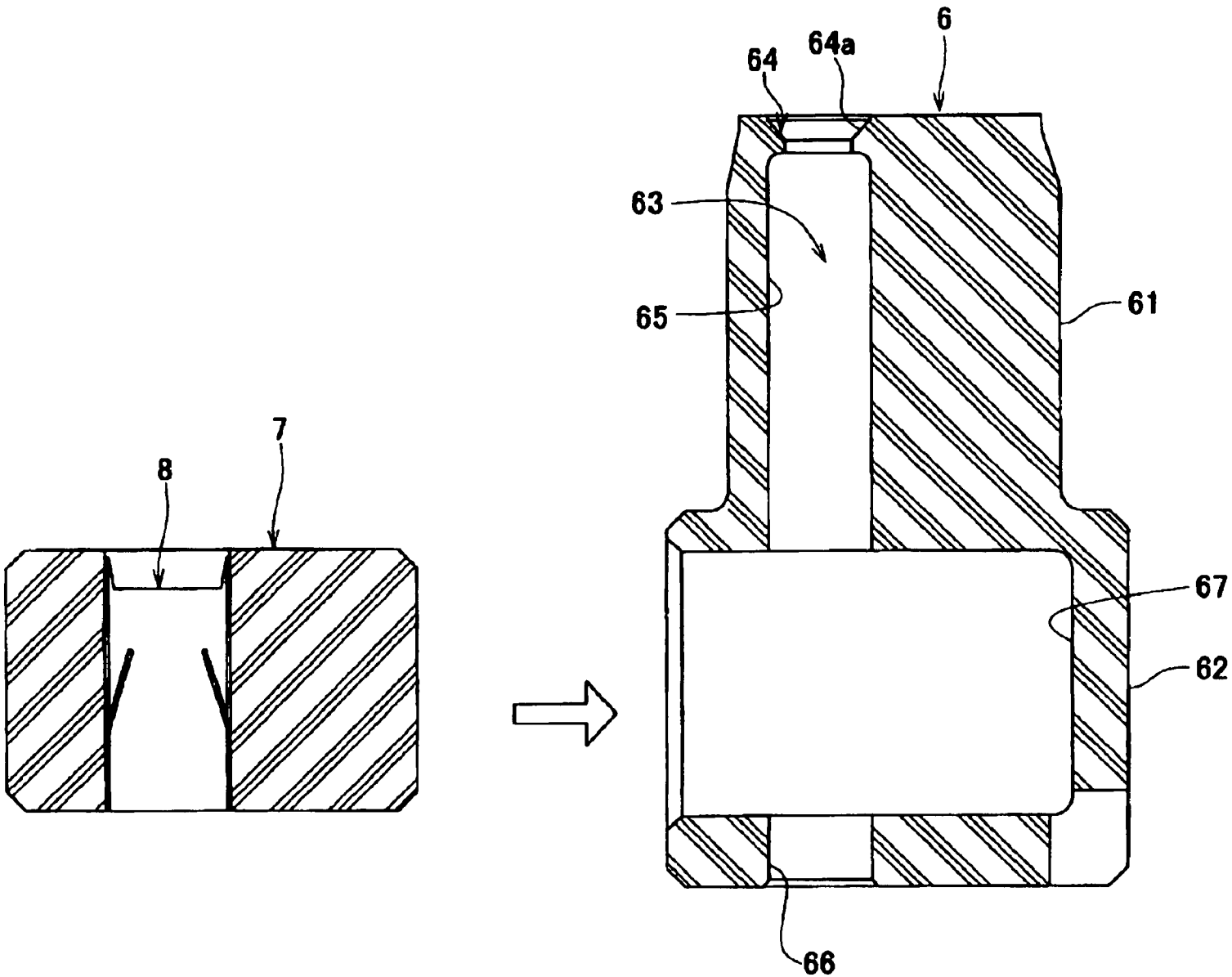
FIG. 3 is a cross-sectional view showing a main housing and a sub housing of the FIG. 1 connector in a state in which the sub housing has not been fitted in the main housing yet.

Referring to FIG. 3, the main housing 6 includes a fitting portion 61 and a gripper portion 62. The main housing 6 is made of a ceramic material. The fitting portion 61 is fitted to the mating connector. The gripper portion 62 is connected to the fitting portion 61. The main housing 6 is formed with a plurality of holes (first holes) 63. The holes 63 each have a guide 64, a contact portion-accommodating portion 65, and a contact-inserting portion 66.

The guide 64 and the contact portion-accommodating portion 65 are formed in the fitting portion 61. The guide 64 has a tapered surface 64*a* for guiding the pin contact of the mating connector into the contact portion-accommodating portion 65. An end of the guide 64 toward the contact portion-accommodating portion 65 has an inner diameter smaller in size than the inner diameter of the contact portion-accommodating portion 65. The contact portion-accommodating portion 65 communicates with the guide 64. The contact portion-accommodating portion 65 accommodates the contact portion 34 of the socket contact 3, the sleeve 4, and the contact portion of the pin contact of the mating connector.

The contact-inserting portion 66 is formed in the gripper portion 62, and has an inner diameter equal in size to the inner diameter of the contact portion-accommodating portion 65. The contact-inserting portion 66 is provided for inserting and removing the socket contact 3 into and from the housing 5. The guide 64, the contact portion-accommodating portion 65, and the contact-inserting portion 66 are arranged on the same straight line.

The gripper portion 62 is formed with a sub housing-accommodating portion 67. The sub housing-accommodating portion 67 removably accommodates the sub housing 7.

Figure 4:
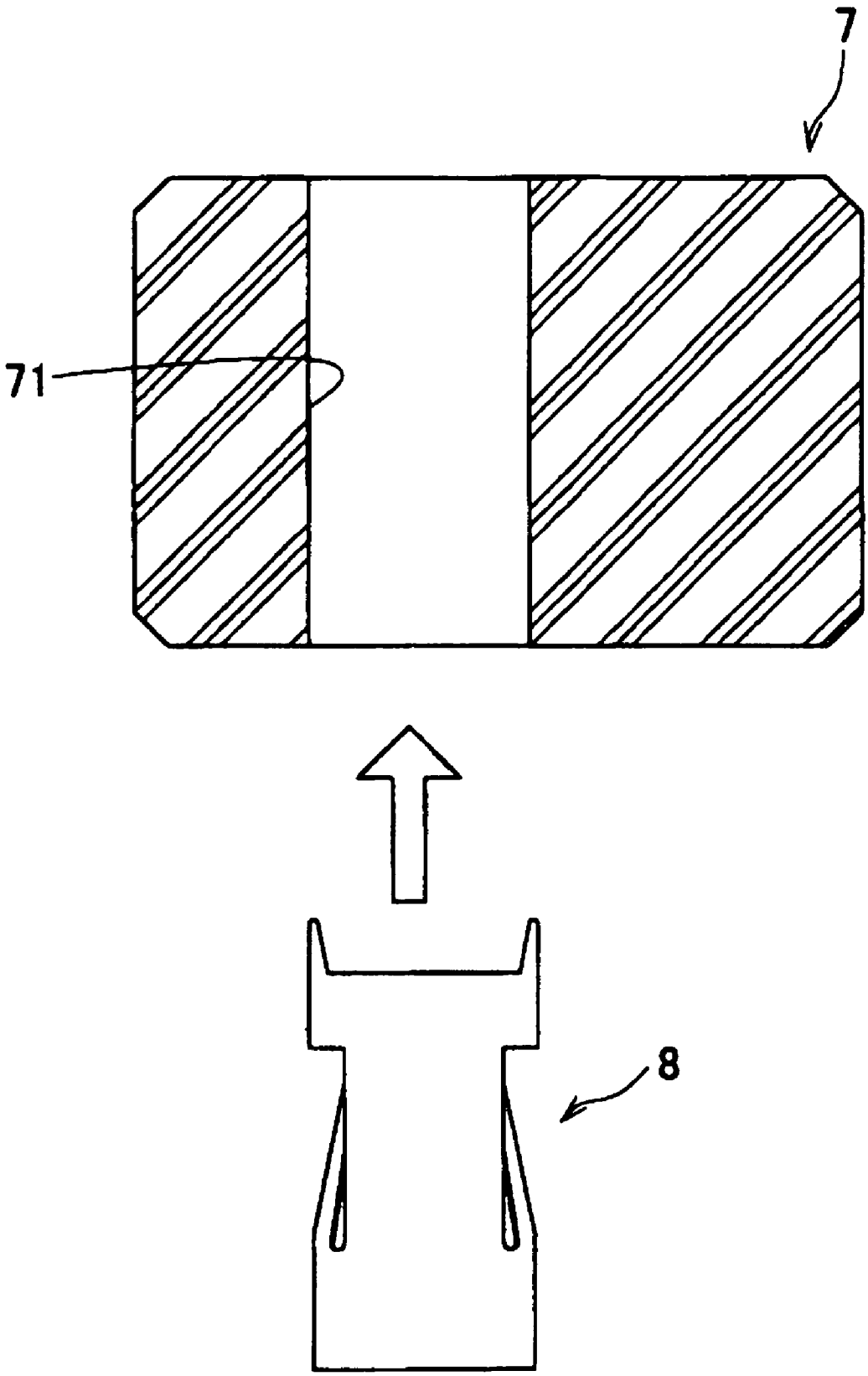
FIG. 4 is a cross-sectional view showing the sub housing and a clip of the FIG. 1 connector in a state in which the clip has not been fitted in the sub housing yet.
Figure 5A:
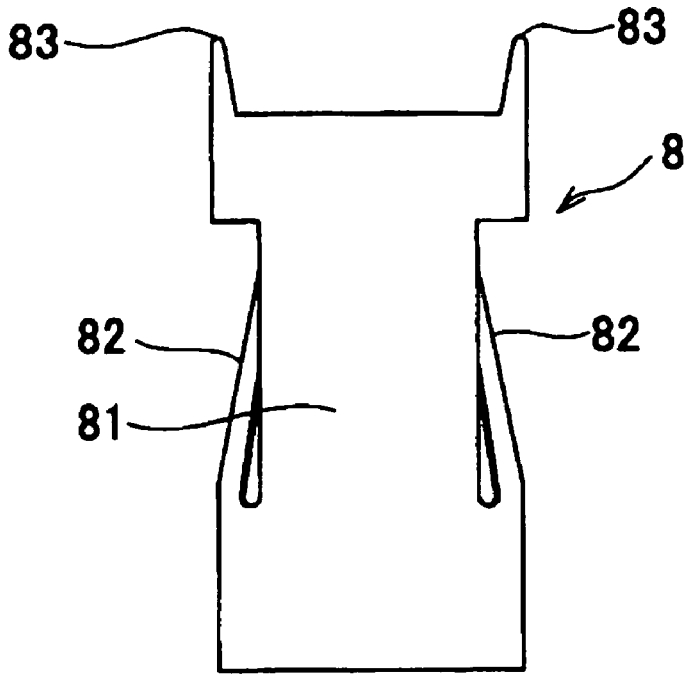
FIG. 5A is a front view of the clip of the FIG. 1 connector
Figure 5B:
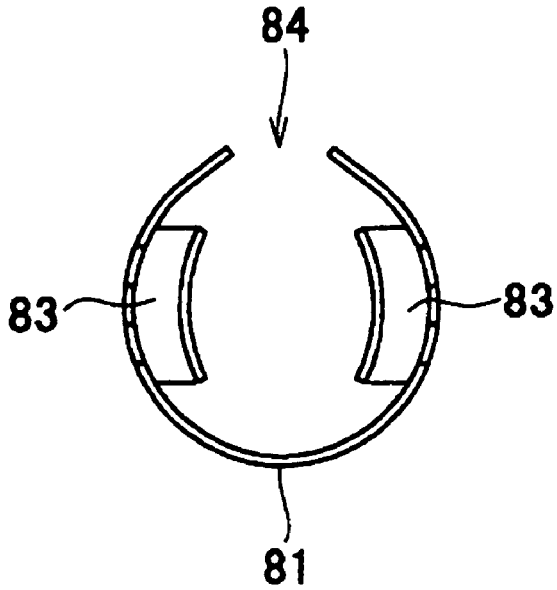
FIG. 5B is a plan view of the clip of the FIG. 1 connector.
Figure 6A:
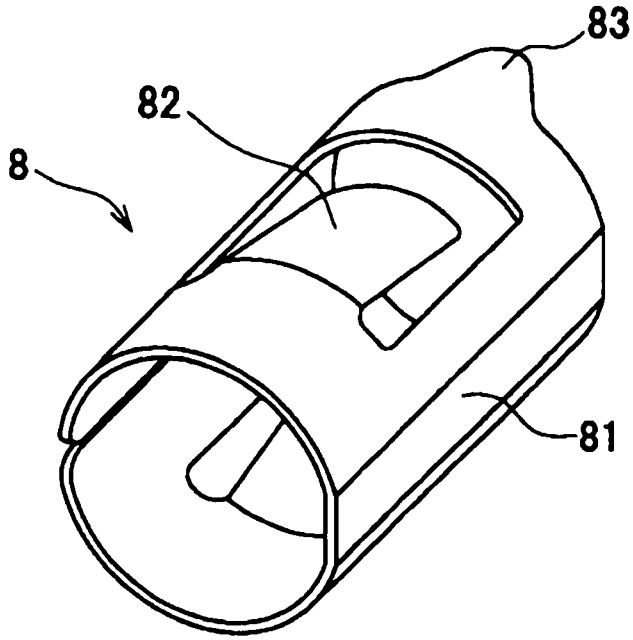
FIG. 6A is a perspective view of the clip appearing in FIGS. 5A and 5B.
Figure 6B:
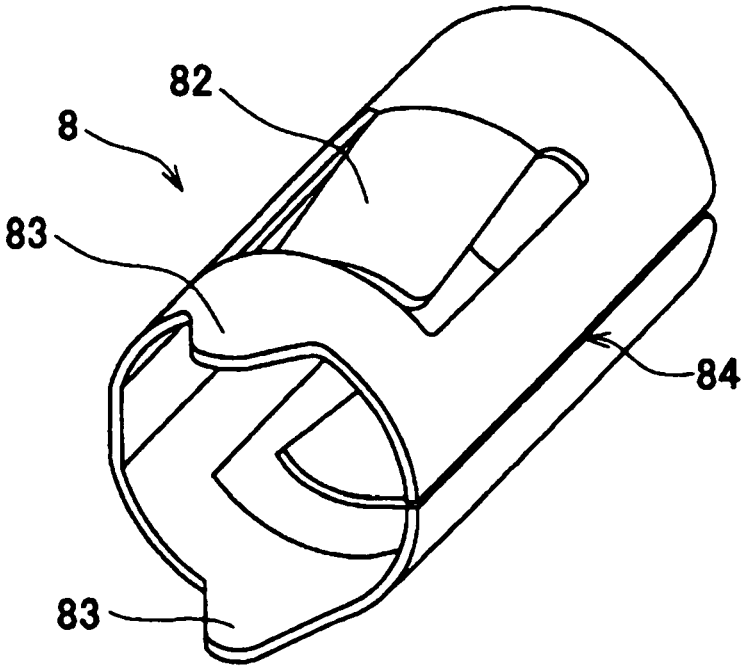
FIG. 6B is a perspective view of the clip, as viewed from a direction opposite to the direction of viewing the clip in FIG. 6A.

As shown in FIGS. 3 and 4, the sub housing 7 has a generally rectangular parallelepiped shape. The sub housing 7 is made of a ceramic material, and is formed with clip-accommodating holes 71. Each clip-accommodating hole 71 has an inner diameter slightly smaller in size than the outer diameter of the clip 8. The clip 8 is elastically deformed in a direction in which the outer diameter thereof is reduced in size, so that when the clip 8 is accommodated in the clip-accommodating hole 71, the clip 8 is held in the sub housing 7 by a resilient force thereof. When the sub housing 7 is accommodated in the sub housing-accommodating portion 67 of the main housing 6, the clip-accommodating hole 71 is continuous with the contact portion-accommodating portion 65 and the contact-inserting portion 66 such that they are arranged on the same straight line. The clip-accommodating hole 71 has an inner diameter larger in size than those of the contact portion-accommodating portion 65 and the contact-inserting portion 66. This difference between the inner diameters forms first and second stopper surfaces 68 and 69 between the clip-accommodating hole 71 and the contact portion-accommodating portion 65 and between the clip-accommodating hole 71 and the contact-inserting portion 66, respectively (see FIGS. 1 and 7). When the sub housing 7 is accommodated in the sub housing-accommodating portion 67 of the main housing 6, the first and second stopper surfaces 68 and 69 are engaged with the clip 8 to block the motion of the clip 8 in the directions D of insertion and removal of the contact 3 to and from the housing 5 of the connector (see FIG. 7).

Next, a description will be given of the clip of the connector shown in FIG. 1 with reference to FIGS. 5A to 6B.

The clip 8 includes a clip body 81, a pair of spring pieces 82, a pair of projections 83, and a slit 84. The clip 8 is made of an elastic metal material. The clip body 81 has a generally hollow cylindrical shape. The pair of spring pieces 82 are cantilevered, and tilted slightly inward of the clip body 81. The pair of spring pieces 82 are opposed to each other in the radial direction of the clip body 81. The pair of projections 83 are continuous with one end of the clip body 81 along the axial direction of the clip body 81. The pair of projections 83 abut against the first stopper surface 68 of the main housing 6. The pair of projections 83 are opposed to each other in the radial direction of the clip body 81. The slit 84, which is formed from one end of the clip body 81 through the other end thereof, extends in parallel with the axis of the clip body 81.

Referring again to FIG. 1 and FIGS. 2A to 2D, the shell 10 is comprised of a front shell 11 and a rear shell 12.

Figure 8:
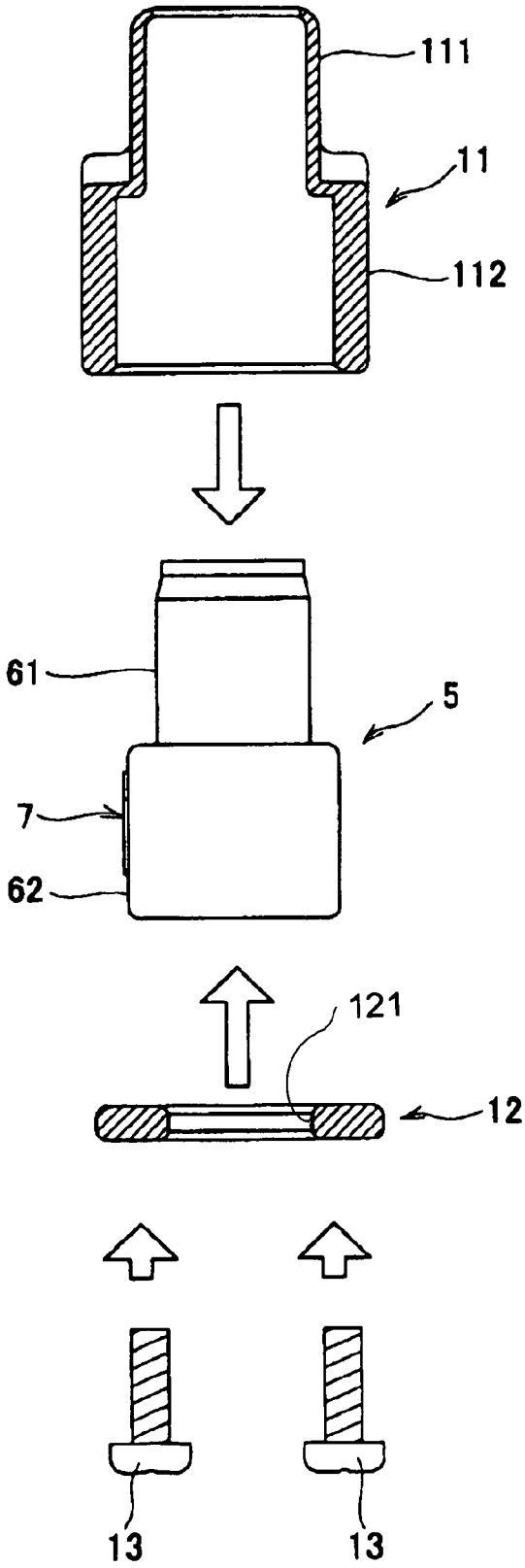
FIG. 8 is a cross-sectional view of the housing of the FIG. 1 connector and a shell in a state before the housing is covered by the shell.

As shown in FIG. 8, the front shell 11 includes a fitting portion 111 and a gripper portion 112. The fitting portion 111 is fitted to the fitting portion of the shell of the mating connector. The fitting portion 111 covers the fitting portion 61 of the main housing 6. The gripper portion 112 is continuous with the fitting portion 111. The gripper portion 112 covers the gripper portion 62 of the main housing 6. The gripper portion 112 has positioning protrusions 113 formed at four corners of a surface thereof opposite from the fitting portion 111 (see FIG. 2A). The gripper portion 112 has screw insertion holes 114 formed through opposite side portions thereof (see FIG. 2B).

Referring again to FIG. 8, the rear shell 12 has a substantially plate-like shape. The rear shell 12 has a central portion formed with a through hole 121 for exposing the contact-inserting portion 66. Formed through opposite side portions of the rear shell 12 are thread insertion holes 122. The thread insertion holes 122 are opposed to the thread insertion holes 114 of the front shell 11, respectively. Male threads, not shown, to be screwed into female threads of the mating connector are inserted into the thread insertion holes 114 and 122, respectively. The rear shell 12 has four corners formed with positioning recesses 123 (see FIG. 2C). The positioning recesses 123 are engaged with respective associated ones of the positioning protrusions 113 of the front shell 11, for positioning the rear shell 12 with respect to the front shell 11.

The front shell 11 and the rear shell 12 are connected by threads 13.

Next, a description will be given how the connector shown in FIG. 1 is assembled.

To assemble the connector, first, as shown in FIG. 4, each clip 8 is accommodated in the clip-accommodating hole 71 of the sub housing 7.

Next, as shown in FIG. 3, the sub housing 7 having the clips 8 mounted therein is accommodated in the sub housing-accommodating portion 67 of the main housing 6. As a result, the respective associated ones of the guides 64, the contact portion-accommodating portions 65, the contact-inserting portions 66, and the clip-accommodating holes 71 are arranged on the same straight lines, respectively, whereby the insertion holes 5*a* (see FIGS. 1 and 4) for inserting the respective associated socket contacts 3 are formed.

Further, each clip 8 is fixedly engaged with the first and second stopper surfaces 68 and 69.

After that, each socket contact 3 is inserted into the associated insertion hole 5*a*. The foremost ends of the spring pieces 82 of the clip 8 are engaged with the flange portion 32 of the socket contact 3, whereby the socket contact 3 is inhibited from being drawn out from the insertion hole 5*a* (see FIG. 1). Further, the sub housing 7 is inhibited from being drawn out from the sub housing-accommodating portion 67 by the socket contact 3.

Then, as shown in FIG. 8, the front shell 11 is fitted on the housing 5, and the rear shell 12 is mounted on the bottom of theses. Further, the front shell 11 and the rear shell are firmly connected using the screws 13, whereby the connector as the assembly of these components is completed.

To disassemble the connector, first, by removing the screws 13, the front shell, the housing 5, and the rear shell are disassembled. Then, the spring pieces 82 and the flange portions 32 are disengaged from each other by a jig, not shown, and the socket contacts 3 are drawn out from the insertion holes Sa together with the jig. After the socket contacts 3 are drawn out from the insertion holes 5*a*, the sub housing 7 is drawn out from the sub housing-accommodating portion 67.

When the sub housing 7 is drawn out from the sub housing-accommodating portion 67, each clip 8 is disengaged from the first and second stopper surfaces 68 and 69, and hence it is possible to draw out the clip 8 from the sub housing 7.

According to the present embodiment, the housing 5 is comprised of the main housing 6 and the sub housing 7, so that when the clip 8 is taken out from the housing 5, there is no need to break the housing 5, which makes it possible to reuse the housing 5 when the connector is repaired.

Next, a description will be given of a connector according to a second embodiment of the present invention, with reference to FIGS. 9 to 10D. Component parts identical to those of the connector according to the first embodiment are designated by identical reference numerals, and detailed description thereof is omitted, while only main component parts different in construction from those of the first embodiment will be described hereinafter.

A housing 205 is comprised of a main housing 206 and a sub housing 207.

The main housing 206 includes a fitting portion 261 and a gripper portion 262. The main housing 206 is formed with a plurality of holes (first holes) 263. Each hole 263 includes the guide 64 and a contact-accommodating portion 265. The contact-accommodating portion 265 has a small-diameter portion 265*a* and a large-diameter portion 265*b*. A first stopper surface 268 is formed on the boundary between the small-diameter portion 265*a* and the large-diameter portion 265*b*.

The sub housing 207 has a substantially plate-like shape, and is placed on the gripper portion 262 of the main housing 206. The sub housing 207 is formed with through holes (second hole) 271. Each through hole 271 has an inner diameter smaller in size than the inner diameter of the large-diameter portion 265*b* of the associated contact-accommodating portion 265 of the main housing 206. Therefore, when the sub housing 207 is placed on the gripper portion 262 of the main housing 206, a second stopper surface 269 is formed between the through hole 271 and the large-diameter portion 265*b*.

The shell 210 is comprised of a front shell 211 and a rear shell 212.

The front shell 211 includes a fitting portion 2111 and a gripper portion 2112. The fitting portion 2111 and the gripper portion 2112 cover the fitting portion 261 of the main housing 206.

The rear shell 212 is substantially in the form of a casing, and includes an accommodating portion 2121 and a through hole 2122. The accommodating portion 2121 accommodates the gripper portion 262 of the main housing 206 and the sub housing 207. The through hole 2122 communicates with the accommodating portion 2121. The through hole 2122 is a hole through which the socket contacts 3 are inserted into the housing 205.

To assemble the connector, first, each clip 8 is inserted into the large-diameter portion 265*b* of the contact-accommodating portion 265 of an associated one of the holes 263. As a result, the protrusion 38 of the clip 8 is brought into abutment with the first stopper surface 268.

After that, the gripper portion 262 of the main housing 206 and the sub housing 7 are placed on upon the other. As a result, each hole 263 and the associated through hole 271 are arranged on the same straight line, while forming the second stopper surface 269. This causes the clip 8 to be fixedly engaged with the first and second stopper surfaces 268 and 269. Further, an insertion hole 205*a* is formed by the hole 263 and the through hole 271.

Next, the front shell 211 and the rear shell 212 are mounted on the housing 5, and the shells 211 and 212 are connected by threads 213.

Then, the socket contacts 3 are inserted into the insertion holes 205*a* through the through holes 271, respectively. As a result, the foremost end of each sleeve 4 is brought into abutment with an end of the contact-accommodating portion 265 toward the guide 64, and the foremost ends of the spring pieces 82 of the clip 8 are engaged with the flange portion 32 of an associated one of the socket contacts 3, whereby the associated socket contact 3 is inhibited from being drawn out from the contact-accommodating portion 265.

To disassemble the connector, first, the spring pieces 82 and the flange portions 32 are disengaged from each other by a jig, not shown, and the socket contacts 3 are drawn out from the insertion hole 205*a* together with the jig. After the socket contacts 3 are drawn out from the insertion holes 205*a*, the threads 213 are removed from the shell 10, and the front shell 211 and the rear shell 212 are disassembled from the housing 205.

Subsequently, the sub housing 207 is removed from the main housing 206.

When the sub housing 207 is removed from the main housing 206, the clips 8 are disengaged from the second stopper surface 269, so that it is possible to draw out the clips 8 from the main housing 206.

According to the present embodiment, the housing 205 is comprised of the main housing 206 and the sub housing 207, and therefore when the clips 8 are taken out from the housing 205, there is no need to break the housing 205, which makes it possible to reuse the housing 205 when the connector is repaired.

Further, the first stopper surfaces 268 formed in the main housing 206 are not configured such that they can be disengaged from the clips 8, but only the second stopper surfaces 269 are configured such that they can be disengaged from the clips 8. This makes it possible to simplify the configurations of the main housing 206 and the sub housing 207.

As described above, the second embodiment makes it possible to obtain the same advantageous effects as provided by the first embodiment, and simplify the shapes of the main housing 206 and the sub housing 207. Therefore, it is possible to further reduce the manufacturing costs of the connector than the first embodiment.

It should be noted that although in the above-described embodiments, the socket contacts are used as contacts, this is not limitative, but it is also possible to use e.g. pin contacts.

Further, although in the above-described embodiments, the connectors include shells 10 and 210, respectively, the invention can be applied to a connector which does not include any shells.

It is further understood by those skilled in the art that the foregoing are the preferred embodiments of the present invention, and that various changes and modification may be made thereto without departing from the spirit and scope thereof.

What is claimed is:

1. A connector comprising:

a contact;

a housing that has an insertion hole for inserting said contact, said housing including a first housing component part and a second housing component part connected to said first housing component part, said insertion hole including a first hole formed in said first housing component part, and a second hole formed in said second housing component part such that the second hole is opposed to the first hole in directions of insertion and removal of said contact, and said first housing component part having an accommodating part for accommodating said second housing component part such that said second housing component part is insertable and removable in directions orthogonal to the directions of insertion and removal of said contact; and a holding member that has a generally hollow cylindrical shape and holds said contact inserted into said insertion hole, said holding member being accommodated in said first hole or said second hole such that said holding member is restricted in motion in the directions of insertion and removal of said contact when said first housing component part and said second housing component part are connected to each other.

2. A connector as claimed in claim 1, further comprising a shell mounted on said housing in a manner covering said housing, said shell comprising a first shell component part and a second shell component part which can be coupled and separated in the directions of insertion and removal of said contacts.

3. A connector as claimed in claim 1, wherein said first shell component part and said second component part are connected by threads.

4. A connector as claimed in claim 1, wherein the first hole has a diameter that is smaller than a diameter of the second hole, and the diameter of the first hole is smaller than an outer diameter of said holding member.

5. A connector as claimed in claim 1, wherein the first hole has a diameter that is smaller than a diameter of the second hole, and the diameter of the second hole is smaller than an outer diameter of said holding member.

6. A connector as claimed in claim 1, wherein said holding member includes an engagement spring that protrudes inward in a radial direction of said holding member, for engagement with an engagement portion of said contact.

7. A connector as claimed in claim 1, wherein said housing is made of a ceramic material.

* * * * *